US007461444B2

(12) United States Patent
Deaett et al.

(10) Patent No.: US 7,461,444 B2
(45) Date of Patent: Dec. 9, 2008

(54) METHOD FOR CONSTRUCTING ANTENNAS FROM TEXTILE FABRICS AND COMPONENTS

(76) Inventors: Michael A. Deaett, 232 Cole Dr., North Kingstown, RI (US) 02852; William H. Weedon, III, 159 Shadow Brook Dr., Warwick, RI (US) 02886

( * ) Notice: Subject to any disclaimer, the term of this patent is extended or adjusted under 35 U.S.C. 154(b) by 346 days.

(21) Appl. No.: 11/090,598

(22) Filed: Mar. 28, 2005

(65) Prior Publication Data

US 2005/0235482 A1 Oct. 27, 2005

Related U.S. Application Data

(60) Provisional application No. 60/557,431, filed on Mar. 29, 2004.

(51) Int. Cl.
*H01P 11/00* (2006.01)

(52) U.S. Cl. ..... 29/600; 29/601; 343/700 MS

(58) Field of Classification Search ..... 29/600, 29/602.1, 830, 846, 852; 343/700 MS, 824, 343/893, 797, 725, 729, 845; 333/185, 202–204, 333/219

See application file for complete search history.

(56) References Cited

U.S. PATENT DOCUMENTS 1,640,929 A 8/1927 Farkouh
3,998,173 A 12/1976 Williamson et al.
4,987,424 A 1/1991 Tamura et al.
5,155,493 A * 10/1992 Thursby et al. ..... 343/700 MS
5,420,596 A * 5/1995 Burrell et al. ..... 343/700 MS
5,440,801 A 8/1995 Marks et al.
5,661,494 A * 8/1997 Bondyopadhyay ... 343/700 MS
5,724,048 A * 3/1998 Remondiere ..... 343/700 MS
5,771,027 A 6/1998 Marks et al.
5,874,919 A * 2/1999 Rawnick et al. ..... 343/700 MS (Continued)

OTHER PUBLICATIONS

Published Application US 2004/0196198, Aisenbrey.

(Continued)

*Primary Examiner*—Minh Trinh

(57) ABSTRACT

Antennas are fabricated using fabric substrates, and, in some embodiments, known stitching techniques to fabricate the conductive members required, including connecting wiring and radiating and/or receiving elements. In one embodiment, one or more "patch antennas", that is, planar radiating and/or receiving elements, are connected to transmitting and/or receiving electronics by means of a connector and feed line structure. The antenna structure comprises multiple layers of fabric, some of which may contain patch antenna and/or feedline patterns made of conductive fabric, made by embroidery using conductive thread or yarn, or onto which patch antennas may be bonded. A ground plane layer may be fabricated similarly. Between the fabric layers containing the conductive patterns, there are one or more layers of insulating fabrics that separate the conductive fabric layers by a dielectric layer. Additional sheets of adhesive between the fabric layers may be used to attach the fabric layers. Alternatively, stitching of insulating thread can be used to attach the multiple fabric layers together. Conductive thread may be used where a connection is desired, that is, the microwave antenna may include a "via" (an interlayer electrical connection) of conductive thread sewn through insulating fabric layers to connect one or more conductive components, typically of conductive fabric. The antenna may be flexible, so as to be used on clothing and the like, or may be impregnated with a curable resin, for forming a rigid structure for incorporation into a larger structure.

18 Claims, 3 Drawing Sheets

U.S. PATENT DOCUMENTS

| | | | | |
|---|---|---|---|---|
| 5,906,004 | A | 5/1999 | Lebby et al. | |
| 6,377,216 | B1 * | 4/2002 | Cheadle et al. | 343/700 MS |
| 6,433,743 | B1 | 8/2002 | Massey et al. | |
| 6,483,464 | B2 * | 11/2002 | Rawnick et al. | 343/700 MS |
| 6,483,469 | B2 | 11/2002 | Boyle | |
| 6,727,197 | B1 | 4/2004 | Wilson et al. | |
| 6,741,221 | B2 | 5/2004 | Aisenbrey | |
| 7,276,917 | B2 * | 10/2007 | Deangelis et al. | 324/661 |
| 2005/0235482 | A1 * | 10/2005 | Deaett et al. | 29/600 |

OTHER PUBLICATIONS

Published Application US 2005/0007290, Aisenbrey.
Published Application US 2005/0006126, Aisenbrey.
Published Application US 2004/0244865, Jung.
Published Application US 2004/0115430, Leonard.

* cited by examiner

METHOD FOR CONSTRUCTING ANTENNAS FROM TEXTILE FABRICS AND COMPONENTS

CROSS-REFERENCE TO RELATED APPLICATIONS

This application claims priority from Provisional Application Ser. No. 60/557,431, filed Mar. 29, 2004.

FEDERALLY SPONSORED RESEARCH

This invention was made in the course of work conducted under contract to the United States Government, under contracts DAAH01-02-C-R128 and DMH01-03-C-R200.

FIELD OF THE INVENTION

This invention relates to methods of constructing antennas; it is disclosed in connection with microwave-frequency antennas in particular, as those are of primary interest, but is not limited thereto.

BACKGROUND OF THE INVENTION

Numerous microwave communications and sensing devices require an antenna for signal transmission and reception. At microwave frequencies of one GHz or more, multilayer microstrip antennas are commonly employed. These antennas may be single or multi-patch antennas which provide energy transmission or reception in many directions simultaneously. To focus the energy, an array of patch antennas fed by a common transmission line is often employed.

These antennas are commonly constructed from sandwiched, parallel laminated layers of insulating substrates and conducting metal sheets. Each metal layer incorporates a two-dimensional pattern designed to efficiently channel radio frequency energy. The design is accomplished by first employing analysis rules and subsequently improving and simulating the design according to procedures known to practitioners of the art of antenna design. Given a set of antenna parameters such as operation frequency, bandwidth, directivity gain, and input impedance, and selected material properties and desired attributes such as dielectric constant, loss factor, sandwich layer thickness and minimal feature size, the best performing antenna is designed.

Typical current practice in microwave antenna fabrication employs a modified form of printed circuit board (PCB) manufacturing technology, in which layers of copper foil are etched according to a design pattern and are sequentially laminated between and/or onto layers of a low-loss dielectric substrate material such as PTFE, or a composite material, e.g., a resin-impregnated reinforcing fiber mat.

The current wide increase in the use of wireless technology for a host of personal and commercial applications has created a need for small microwave antennas that can be incorporated into clothing, vehicles, briefcases, and the like. If incorporated into ordinarily flexible fabric articles, such as wearable clothing, tote bags, or vehicle covers, a rigid PCB antenna would create undesirable rigid portions, tending to form objectionable lumps that would be uncomfortable in clothing, and would cause increased fabric wear, reducing article lifetimes and limiting applications. Rigid PCB antennas are also unsightly without added encumbering packaging and are considered unacceptable for many applications, indoor and outdoor. With the increasingly ubiquitous wireless applications, improved aesthetic qualities are desirable. Materials of an order of magnitude less cost are also desired to enable wider applications.

Other problems inherent in the use of PCB antennas are as follows. Transitioning a conventional PCB antenna design to manufacturing can require several weeks; a more rapid turn around time enabling custom applications at a reasonable cost is desirable. A conventional PCB antenna can deform under heat and can transmit excessive levels of acoustic noise and vibration. Further, conventional PCB techniques employ environmentally hostile etching or time-consuming milling steps to implement the desired waveguide patterns into the metal foil.

There are applications for the incorporation of antennas into airframes, ship superstructures or composite support beams for buildings for which conventional PCB techniques are not suitable, due to structural weakening that occurs when a conventional antenna laminate is incorporated into a composite superstructure; due to incompatibility of the materials used, the antenna might tend to delamination. An antenna construction technology that enables an integral antenna to be made without reducing the electronic characteristics or working life of the antenna is needed.

Conventional arrays of antennas are limited in size due to the manufacturers' ability to make and work with large sheets of PCBs. Therefore, arrays covering hundreds of square meters, such as those desired for satellite applications, are very difficult to manufacture. Inevitably, they would have to be fabricated in panels, further complicating the structural and connection issues.

Various paint-on or print-on techniques employing conductive paints or inks have been suggested as alternatives to the conventional PCB laminate methods. These applique methods produce antennas that crack and flake when the antenna is flexed, or if the underlying substrate expands and contracts due to thermal variation, resulting in degraded performance. Flexing due to predeployment packaging as well as vibration can produce differential stress on these antennas and contribute to antenna failure. Additionally, exposure to ultraviolet light and to atmospheric oxygen causes erosion of the metallic applique that greatly reduces performance and lifetime.

OBJECTS OF THE INVENTION

It is therefore an object of this invention to provide methods of manufacturing antennas using textile materials and textile industry fabrication techniques.

It is a further object of this invention to provide a method of constructing wider bandwidth antennas within given design size and weight requirements than is now possible.

It is a further object of this invention to provide a method of constructing light weight, low cost antennas for a multitude of purposes.

It is a further object of this invention to provide a method of constructing flexible antennas that can be folded without damage, to permit compact storage and more efficient transportation of the antennas between use, and to enable the antenna to become a part of a foldable textile garment or product, or to be molded into a conformal composite structure.

It is a further object of this invention to provide a method of constructing comfortable clothing incorporating an integral antenna.

It is a further object of this invention to provide a method of constructing antennas of improved functional life expectancy.

It is a further object of this invention to provide a method of constructing antennas that are aesthetically pleasing and that may be incorporated into such common textile products as artificial flowers, cellular telephone towers, awnings, tarps, vehicle covers, wall coverings, apparel, and other products.

It is a further object of this invention to provide an efficient method of constructing antennas of far greater size that those manufacturable employing current practices.

It is a further object of this invention to provide a method of constructing antennas providing for reduced vibration and sound transmission.

It is a further object of this invention to provide a method of constructing antennas with improved resistance to degradation due to exposure to terrestrial and space environments containing atmospheric oxygen, thermal transients, ultraviolet light, high energy particles, and acids.

It is a further object of this invention to provide a method of constructing antennas that can withstand high shock loads and impacts, e.g. of bullets, with minimal degradation.

It is a further object of this invention to provide a method of constructing antennas that have improved manufacturability and shortened lead times from prototype to production.

SUMMARY OF THE INVENTION

According to this invention, antennas are fabricated using fabric substrates, and, in some embodiments, known stitching techniques to fabricate the conductive members required, including connecting wiring and radiating and/or receiving elements.

In one embodiment, one or more "patch antennas", that is, planar radiating and/or receiving elements, are connected to transmitting and/or receiving electronics by means of a connector and feed line structure. The antenna structure comprises multiple layers of fabric, some of which may contain patch antenna and/or feedline patterns made of conductive fabric, made by embroidery using conductive thread or yarn, or knitted into the fabric. A ground plane layer may be fabricated similarly. Between the fabric layers containing the conductive patterns, there are one or more layers of insulating fabrics that separate the conductive fabric layers by a dielectric layer. Additional sheets of adhesive between the fabric layers may be used to attach the fabric layers. Alternatively, stitching of insulating thread can be used to attach the multiple fabric layers together. Conductive thread may be used where a connection is desired, that is, the microwave antenna may include a "via" (an interlayer electrical connection) of conductive thread sewn through insulating fabric layers to connect one or more conductive components, typically of conductive fabric.

More specifically, in one preferred embodiment, a microwave antenna comprises a first layer of rectangular conductive patches and feed lines formed on a planar retaining fabric or made of a further layer of conductive fabric, a dielectric spacer fabric layer maintaining a constant distance between the antenna fabric layer and a conductive ground plane layer comprising a conductive fabric, and a connector providing an external connection between the antenna patch feeds and the conductive ground plane and external electronic equipment. Depending on the application, a rigid form-retaining supporting structure may be employed, or the antenna can be integrated with a flexible article, such as clothing, or it can be formed integrally onto a rigid structure, such as the leading edge of an airplane's wings, the fuselage of a helicopter, the superstructure of a ship, or the like. Filters, including, for example, frequency-selective structures formed on radomes, may also be fabricated using the techniques of the invention.

In a preferred embodiment, the microwave antenna may be fabricated by composite resin impregnation of the microwave antenna fabric layers, providing both the desired dielectric constant for the spacer layers and a rigid structure supporting the antenna without additional structure. This embodiment is particularly suitable for incorporation into a secondary structure, such as an airframe, a ship superstructure, or a building frame beam. The resin impregnation step may be performed using known techniques including resin transfer molding, vacuum bagging, hand lay-up or other alternatives.

In the preferred embodiment, the antenna is impedance matched to the drive line through a microstrip transformer which consists of a thin patch that connects the bonding pad to the antenna patch. Alternatively, an industry standard "SMA" connector is connected to the feed network and to the ground plane structure, to provide an electrical connection to an associated electronic device.

In a further embodiment, elements of a dipole or other wire antenna can be fabricated on a single fabric layer by stitching employing conductive thread.

BRIEF DESCRIPTION OF THE DRAWINGS

Other objects, features and advantages will occur to those skilled in the art from the following description of a preferred embodiment and the accompanying drawings, in which:

FIG. 3(*b*) is a similar view showing the adhesive transfer of an antenna pattern fabric to a retaining fabric layer;

DETAILED DESCRIPTION OF THE PREFERRED EMBODIMENTS

Figure 1:
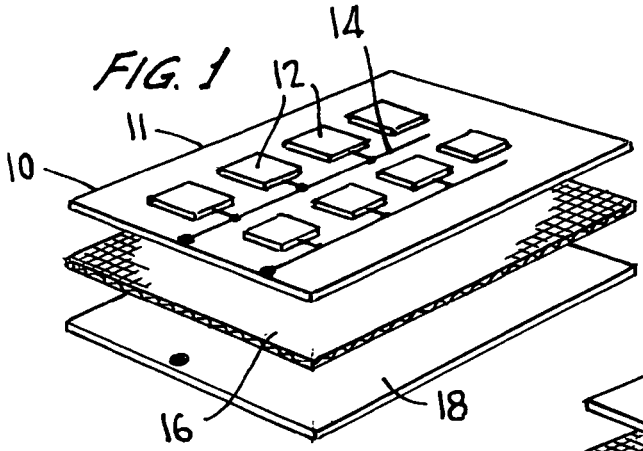
FIG. 1 is a schematic, perspective, exploded view of a textile-based microstrip antenna.

FIG. 1 shows one embodiment of a three-layer microstrip microwave array antenna according to the invention. A first layer 10 comprises a retention fabric 11 on which conductive patch antennas 12 and feed lines 14 are disposed. These elements may be fabricated of conductive thread, stitched to form the desired patterns, or comprise metallized fabric cut to form the desired patterns. A second spacer fabric layer 16 provides the necessary dielectric material spacing the first layer from a third layer 18, comprising a conductive metallized fabric, which serves as the ground plane, that is, the antenna waveguide boundary. The feed lines and ground plane can be connected to the associated electronics using techniques discussed below.

Examples of the metallized fabric that can be used as the ground plane and to form the patch antenna elements and feed lines are ShieldEx RTFK 151G; 3M Conductive Copper Impregnated Polyester Tape; 100 Count, 46 Ga. woven copper cloth; Graphite fabric; Bekinterm Stainless steel woven cloth FA-750; and MarkTek 17ENL Ni/Ag/Nylon Leno Fabric. Examples of the conductive threads or yarns that can be used to form the patch elements and feedlines (and ground plane, if desired) include Concordia 196 595/1; ShieldEx 117 2 ply with Stainless; Bekaert VN 14/1×90/100Z/316L Stainless; and Bekaert VN 50/1/304 Stainless. Examples of the spacer fabric include Nomex honeycomb; Gehring Knit Spacer #002026 White Polyester; Gehring Knit Spacer # MSHR 778F White Polyester; Gehring Knit Spacer # MSHR 725F Polyester; and Gehring Knit Spacer # MSHR 700 Polyester. Examples of the retention fabric include EBX-17 Oz. Fiberglass and Codura nylon. Of course, the invention is not to be limited to these specific materials.

As noted above, the layers can be joined to one another by adhesive bonding, by stitching, or by impregnating the assembly with a hardening resin, such as epoxy or the like. In the latter case, a substantially rigid antenna will be formed that would be suitable for incorporation onto an airframe or the like. However, the antenna thus formed will likely be lighter than one made using PCB techniques, can be formed to essentially any shape and size desired, and can be made inexpensively with minimal tooling. If the antenna is assembled by adhesive bonding or stitching it will be flexible and could be incorporated into clothing or the like; such antennas are foldable, impact resistant, lightweight, inexpensive, and durable, making them suitable for a wide range of applications.

Figure 2:
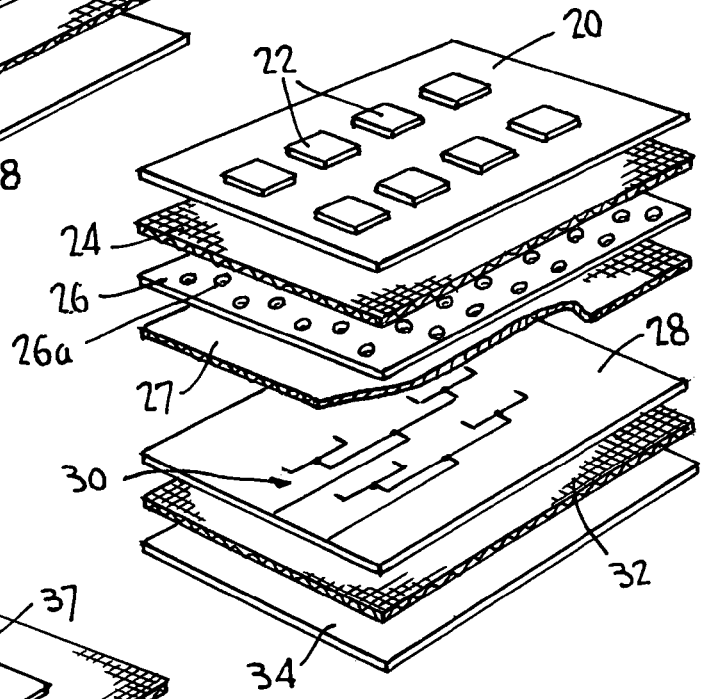
FIG. 2 is a similar view of a seven-layer textile stripline antenna.
Figure 6:
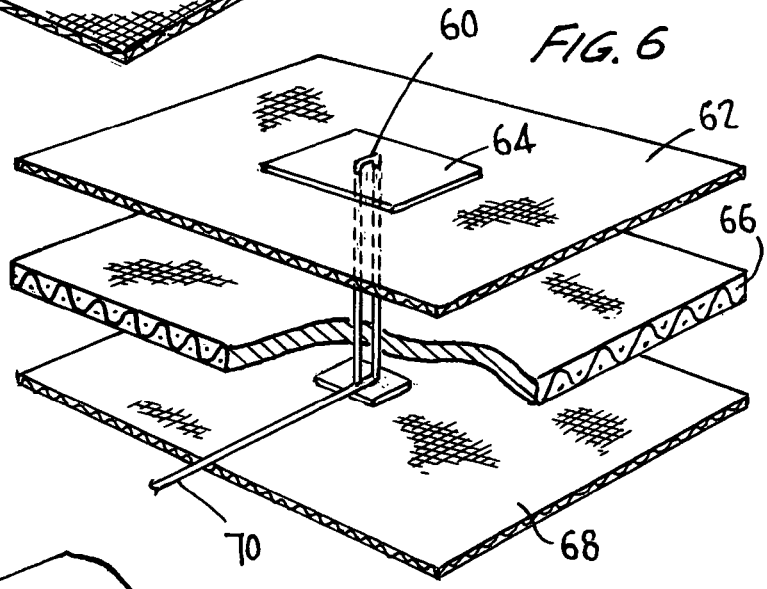
FIG. 6 is an exploded view illustrating through-layer interconnect stitching.

FIG. 2 shows a stripline microwave antenna design comprising a first retention fabric layer 20 on which are disposed conductive yarn or metallized fabric members 22 making up the antenna patch elements, a spacer fabric layer 24 separating the first antenna pattern layer 20 from a first conductive ground plane layer 26 formed of metallized fabric, the first ground plane layer 26 being separated by a second spacer layer 27 from a second retention fabric layer 28 containing a yarn or metallized fabric pattern of conductive feed lines 30, and a third spacer fabric layer 32 separating the feed layer 28 from a second ground plane layer 34. Connections between the patch elements 22 and the feed lines 30 can be made by through-stitching using conductive thread, as detailed below in connection with FIG. 6; in that case, the intermediate ground plane 26 must be patterned to define apertures 26*a* through which these threads can pass. Alternatively, if the frequency is appropriate, the energy can simply be transmitted through the apertures 26*a*, without a discrete connection. It is known to those practiced in the art that many other multilayer microwave antenna configurations similar to those shown are possible. The materials and techniques discussed in connection with FIG. 1 are useful in connection with the FIG. 2 antenna as well.

More specifically, one method of fabricating microwave feed lines, microwave antenna array patterns, and microwave antenna ground planes is by embroidery onto a base embroidery fabric, using one or more of a selection of metallic yarns or threads. The embroidery can be accomplished using a conventional lock stitch, chain stitch or chenille embroidery machine such as, for example, a Tajima 603. As listed above, suitable metallic yarns include silver coated nylon or polyester yarns or stainless steel yarns such as, for example, Bekinox VN or ShieldEx 117 2 ply with stainless steel yarn, or any single filament wire or twisted metallic yarn that can be embroidered using such machines. The desired antenna pattern is first digitized using, for example, Wilcom digitizing software with the chenille digitizing software module. The digitization process selects the entire sequence of stitches to be used and determines the placement of the individual stitches into the fabric required to realize the desired patterns. The digital pattern specification is then transferred to the controller of the chenille embroidery machine which then embroiders the yarn into the retention or embroidery fabric. In some cases, however, hand stitching may be preferred.

The embroidery or retention fabric may be "Codura" nylon or any of several other fabrics found to be useful through experimentation. The best stitch pattern is that which produces a dense metallization pattern while reducing pulls or other defects, and will be established by experimentation. A nonwoven backing may be adhered to the reverse side of the embroidery fabric to enhance embroidability. This fabric may be intended to be torn away or be a permanent part of the antenna.

Figure 3A:
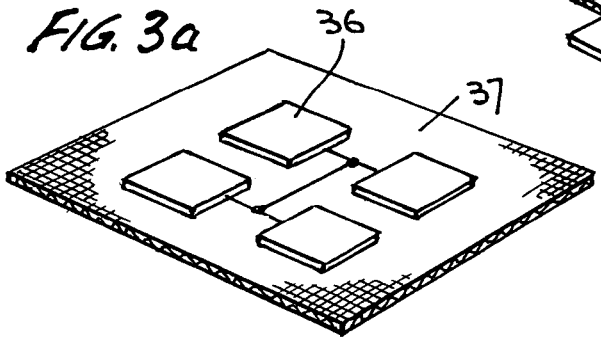
FIG. 3(*a*) is a similar view of a metallized antenna fabric pattern with adhesive transfer paper attached.
Figure 3B:
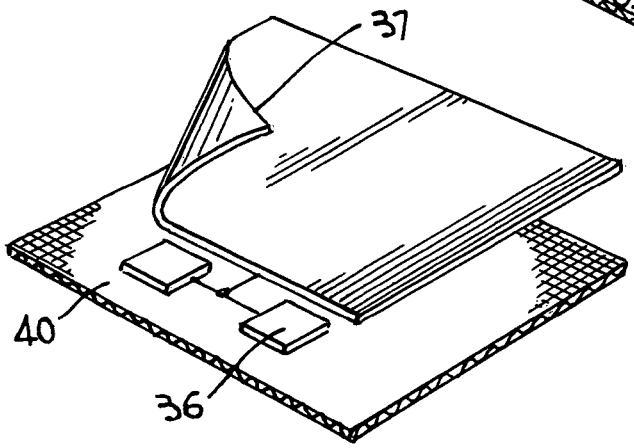

Another suitable method of constructing microwave antenna patch panels and grounds is shown in FIG. 3. Briefly, the conductive elements 36 desired may be cut from a metallized fabric such as, for example, ShieldEx RTFK 151G, using a laser cutter or other suitable tool. More specifically, the ShieldEx material is available with a thermosetting adhesive coating on one side. A suitably sized panel of this material is disposed over and temporarily bonded to a sheet of adhesive film transfer paper 37, and placed on the cutting table of a laser cutter or other tool, with the adhesive-coated side of the ShieldEx fabric up. See FIG. 3(*a*). The laser cutter is then operated so as to cut out the desired pattern from the ShieldEx material, without cutting into the underlying transfer paper 37. Using the transfer paper to pick it up, the patterned ShieldEx material is then placed face down onto a sheet of the desired dielectric spacer layer 40, or onto a sheet of a supporting retention fabric layer, if desired. In this way, the geometric form of the pattern is preserved by the transfer paper 37 while the patterned fabric 36 is placed over the dielectric layer 40 or retention fabric. The metallized fabric pattern is then adhered to the dielectric layer 40 or retention fabric by heat applied with a thermal press according to an established pressure and temperature cycle, that is, employing the thermosetting adhesive coating thereon, or a separate layer of film adhesive if need be. The transfer paper 37 can then be peeled off as illustrated in FIG. 3(*b*) and discarded. This assembly would then be bonded to a spacer fabric layer, if needed, and a conductive ground plane fabric, and a connector added as discussed below, to form the complete antenna.

Figure 4:
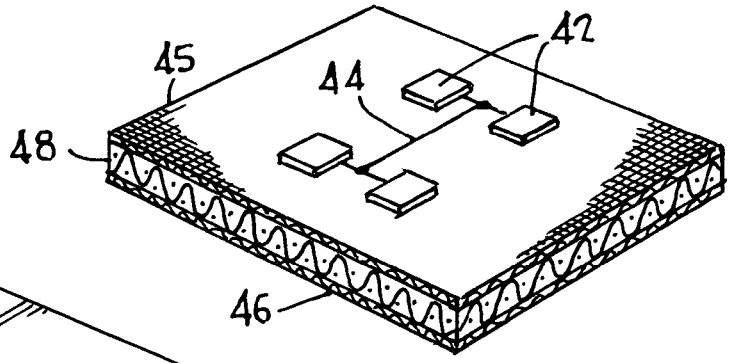
FIG. 4 is a similar view showing the sandwich structure of an antenna according to one embodiment of the invention.

An alternate method of constructing the antenna elements 42 and connecting feed lines 44, as well as the conductive ground plane 46, is knitting these elements into opposed surfaces of a warp knit fabric such as Gehring MS 725 fabric using metallized yarn to form the desired patterns, as illustrated in FIG. 4. The central portion of the fabric 45 thus itself serves as a spacer layer 48.

More specifically, laminated textile multilayer microwave antennas can be assembled using a heat-activated textile adhesive such as the pressure-sensitive adhesive coating available on the Shield-Ex fabric to bond the multiple layers together. Bemis Heat Seal 4220 5 mil film adhesive can be used if it is desired to use a fabric not available with an adhesive coating. The individual layers are first constructed as discussed above. Using a thermal press, the antenna pattern is first adhered to the spacer fabric, forming a first laminated antenna component. Thereafter, the second conductive metallized pattern layer is thermally bonded onto the first laminated antenna component. Likewise, for each additional component antenna layer desired, a sheet of adhesive is placed between the previously constructed laminated component(s) and thermal pressure is applied to melt and set the adhesive. If the materials to be used are such that multiple heating steps are desirably avoided, contact cement can be used in lieu of thermosetting adhesives. Suitable adhesives include Capitol 017 Latex Sealer/Adhesive, 3M #77 Contact Adhesive, and Durabond D 15 seam Adhesive. Accurate registration of the multiple layers can be accomplished by first incorporating fiducial marks in the patterns, cutting all of the holes according to the fiducial marks, and then aligning the fiducial marks with a needle while placing the multiple layers on the thermal press.

Figure 5:
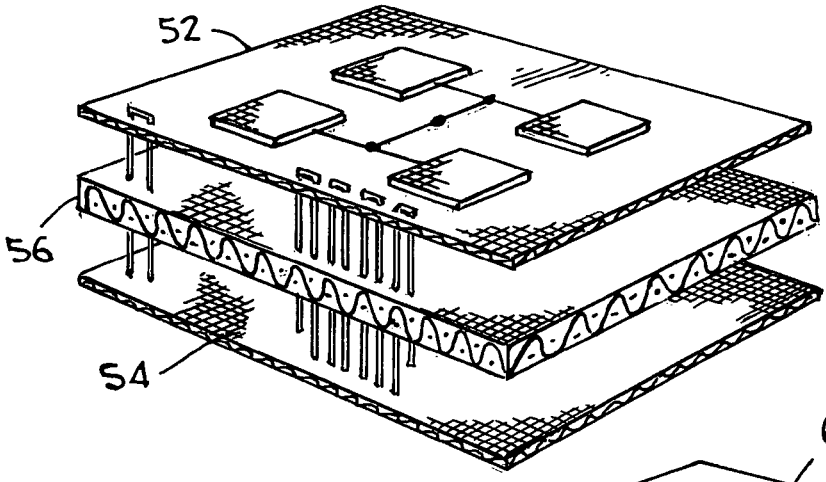
FIG. 5 is an exploded view of a multilayer microwave antenna construction showing isolated tack stitching and continuous zig-zag attachment stitching.

Alternatively, or additionally, multi-layer structures can be assembled by stitching, as shown in FIG. 5. Tack or zig-zag stitching using non-conductive thread or yarn can be used to secure the multiple layers. The multiple fabric layers, including a first fabric layer 52, with active antenna elements and feedlines formed thereon using either of the methods discussed above, and a ground plane layer 54, are assembled with a spacer layer 56 therebetween. The layers are aligned by the use of the fiducial alignment holes mentioned above. The multiple layers may then be tack stitched to one another using a lock stitch tacker such as, for example, that manufactured by Global, preferably having been modified to include a bobbin thread tension release tongue, so that the pressure foot does not unduly compress the textile spacer fabric during stitching. Zig-zag stitching may also be usefully employed.

The "vias", or conductive connections required between, e.g., the layers of multilayer stripline antennas discussed above in connection with FIG. 2, can be constructed by incorporating through-layer connections made by tack stitching using conductive metallic yarns. See FIG. 6. The stitching method may be chain stitching or lock stitching. By this method, a vertical conductive connection is formed. As an example, a tack stitch of a 2 mm circular pattern, as shown at 60, or another regular pattern, can be employed so as to extend though a layer 62 incorporating active elements 64, a spacer layer 66, and layer 68 having a feed line 70 formed thereon of embroidered conductive thread, thus connecting the active element 64 to its feed line 70. This structure could then be adhesively bonded or stitched to another spacer layer and a ground plane layer (not shown). Thread or yarn of silver plated nylon or polyester, stainless steel, or blends of silver coated thread, stainless steel and nylon, including but not limited to those listed above, may be used. The specific thread to be employed is selected based on sewability and conductivity for each application.

Figure 7:
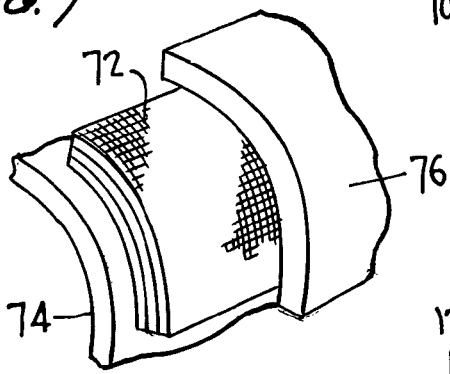
FIG. 7 is an exploded view of a multilayer textile microwave antenna formed using a compression mold.

As discussed briefly above, in many applications it would be desirable to make an antenna on a fabric substrate, or in a multilayer construction wherein each of the layers are flexible, but to then cause the assembly to take a desired rigid shape. Antennas thus made would be usefully applied to structures such as airframes, e.g., the leading edges of airplane wings, ship superstructures, helicopter fuselages, radomes, and the like. This can be accomplished by impregnating the laminated textile antennas constructed as discussed above with curable resins, such as those used for making composite structures of fiberglass, wherein a fiberglass cloth is impregnated with a polyester, vinylester, or epoxy resin, which then cures, resulting in a rigid and durable structure. Any of a large variety of techniques known in the composite manufacturing industry might be used, as might any of the commonly-used fabric materials and curable resins. For example, the desired resin might be infused by the repetitive impression with hand applicator (hand lay-up), or by the injection of the resin during resin transfer molding. Vacuum bag techniques might usefully be employed to cause the resin-impregnated fabric assembly to conform to a mold, or directly to the structure to which the antenna is to be assembled. See FIG. 7. The resin-impregnated fabric assembly 72, including the assembled multilayer microwave antenna, is placed between mating mold halves 74 and 76, clamping pressure is applied by vacuum bagging or otherwise, and the resin allowed to cure. Alternatively, the inner mold half 74 could itself comprise the structure to which the antenna is to be assembled. Possible resins include epoxy resins, polyester resins and others with a cure cycle that is compatible with the textile component fabrics and materials. The fabric substrate on which the active antenna components are formed could be fiberglass, Kevlar, Astroquartz, Nomex, carbon fiber, or others.

Figure 8:
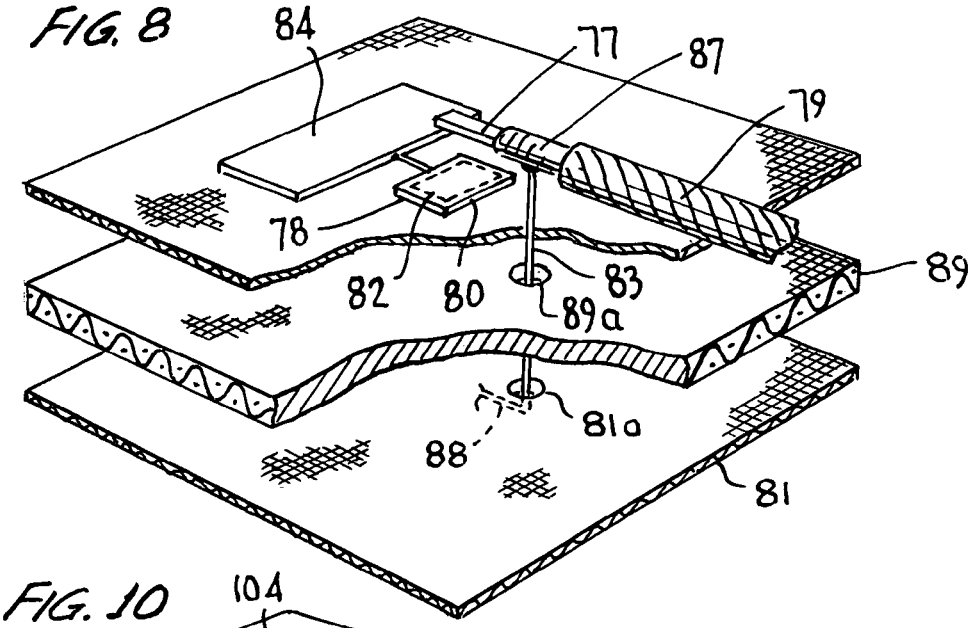
FIG. 8 shows a method of direct conductive wire attachment using a sewn pad of conductive screen.

One possible method of connecting the central conductor and braided shield of a coaxial cable to feedline wire patterns and the ground plane, respectively, these having been formed as above, is shown in FIG. 8. A small patch 78 of conductive metal screen is first sewn, using metal thread or wire 80, to a formed conductive metal feed pad 82 that has been embroidered into the fabric, together with the active antenna element 84. The signal is then coupled to the active element by the center conductor 77 of a coaxial connector cable 79, soldered to the patch of metal screen 78. A short length of the braided shield 87 is formed into a "pigtail" 83. This pigtail 83 is then passed through a hole 89a in the spacer fabric 89 and again through a hole 81a in the conductive grounding face fabric 81. The pigtail 83 is then soldered directly to the conductive grounding fabric 81, as indicated at 88. Fabric 81 must accordingly be capable of withstanding the heat of soldering. In an alternate embodiment, a second square patch of conductive metal screen similar to patch 78 may be stitched to the conductive fabric 81 adjacent to the hole 81*a* and the pigtail 83 then soldered to the second metal screen patch.

Figure 9:
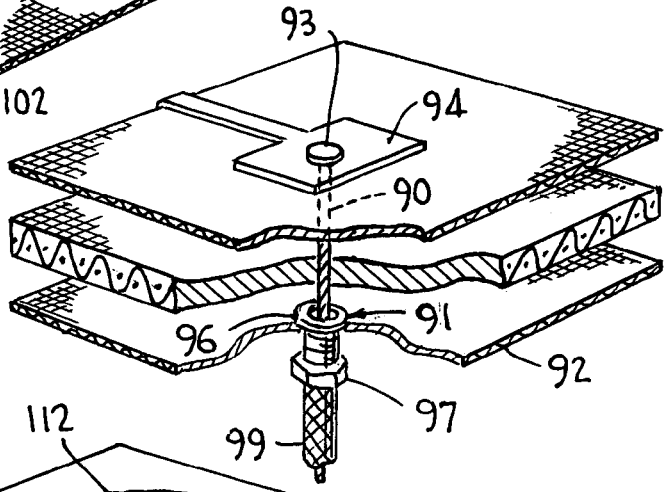
FIG. 9 shows one way in which a coaxial cable connector can be connected to a textile antenna.

It is often desired to employ industry-standard coaxial cable and suitable connectors to connect the antenna to the transmitting and/or receiving electronics. Silver-bearing conductive epoxy "solder" can be used to connect a coaxial microwave connector to laminated textile antennas according to the invention. See FIG. 9. The center conductive lead 90 of, for example, a microwave SMA connector 91 is passed through a hole formed in the ground plane 92 and attached to the conductive fabric 94, patterned as above, using silver epoxy. The connector base 96, to which the connector 97 of the coaxial cable 99 is threaded, is then attached to the ground plane 92, again typically using conductive silver epoxy 93. Additional epoxy can be added for greater strength of the bond.

Figure 10:
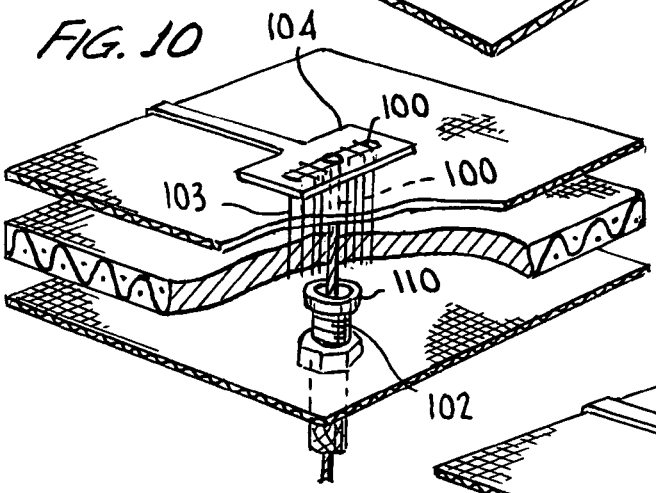
FIG. 10 shows another method for attaching a coaxial cable connector to a textile antenna.

In an alternative shown in FIG. 10, the center conductor 100 from the connector 102 is attached to the patterned antenna element 104 by bending the conductor over and stitching it, with nonconductive thread 103 extending through the dielectric layer 106 and the ground plane 108, to the pattern 104. The body of the connector can again be attached to the ground plane using conductive epoxy 110.

Figure 11:
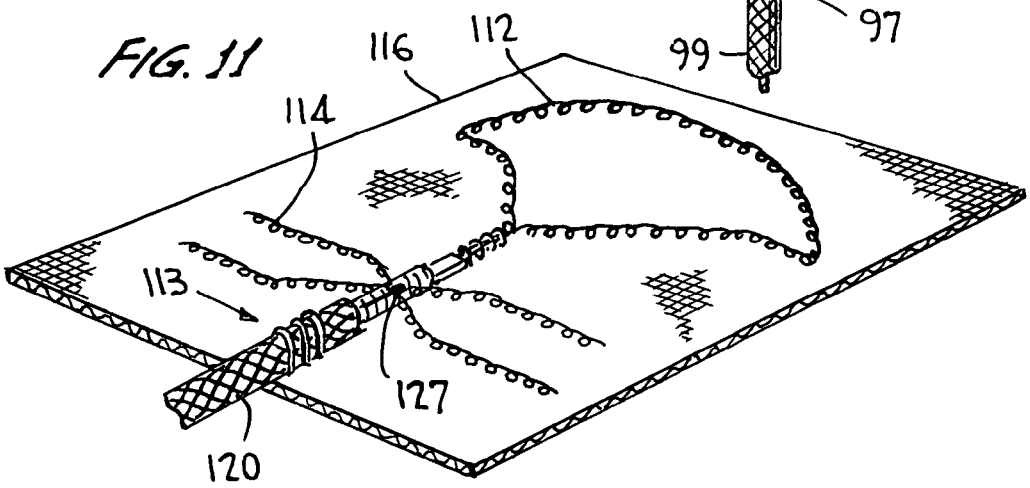
FIG. 11 shows a second embodiment of the textile antennas according to the invention.

In the above we have focused making laminated antennas, that is, in which the active antenna elements are essentially planar members spaced from a planar ground plane by a dielectric spacer member. Dipole and other "wire" antennas, where the active and ground elements are elongated elements lying in a single plane, can also be usefully constructed using the techniques of the invention. See FIG. 11. The active element 112 and ground conductor 114 of a dipole antenna are formed on a fabric substrate 116 by embroidery using conductive thread or yarn, as above. The stitch pattern chosen might be a chenille, chain stitch, lock stitch, or others. Connections could be made by soldering connective leads to the active element 112 and ground conductor 114, by simply stitching the leads into the active element 112 and ground conductor 114, or by epoxy bonding, as above. In the illustrated technique, which is preferred, the central conductor 118 and shield conductor 127 of a coaxial cable 120 are directly attached to the active element 112 and ground conductor 114, respectively. The conductors of the coaxial cable 120 are joined to the corresponding conductors of the antenna by stitching using stainless thread. The stitched connections are then carefully impregnated by silver-bearing epoxy; when this cures, further non-conductive epoxy can be added, to further reinforce the area of the bonds. Additional strain relief for the cable 120 can be provided by stitching it to the substrate 116, as illustrated at 113, using non-conductive thread, and then impregnating this connection with non-conductive epoxy.

Figure 12:
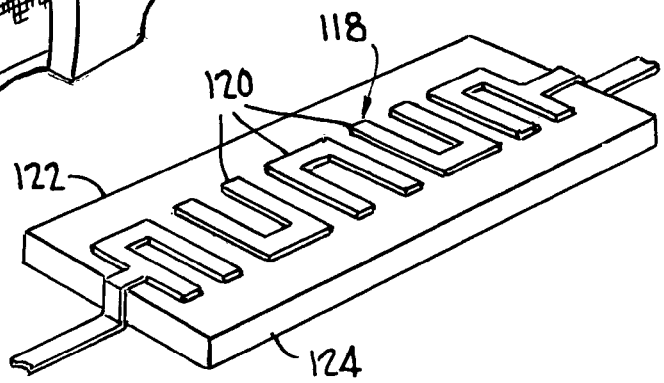
FIG. 12 shows a frequency-selective filter made using the techniques of the invention.

Finally, the techniques of the invention can also be used to fabricate frequency selective structures, such as filters. See FIG. 12. A conductive filter structure 118, comprising a number of unconnected elements 120, is disposed on a fabric substrate 122, and a ground plane 124 is formed on the opposite surface of the substrate. Connections can be made to leads at either end of the active structure 118. The techniques described above can be used according to teachings known to the art to fabricate a filter structure that will substantially attenuate radiation of frequencies except in a relatively narrow pass band, which simplifies detection and amplification. Accordingly, such a filter might usefully be incorporated into the structure of a radome, for example.

While several preferred embodiments of the invention have been described in detail, the scope of the invention should not be limited by the above exemplary disclosure, but only by the following claims.

What is claimed is:

1. A method of constructing an antenna, filter, or similar structure comprising one or more planar electrically conductive radiating and/or receiving elements having conductive feedlines attached thereto and a planar ground reference conductor spaced therefrom by a spacer layer, comprising the steps of:

providing a planar dielectric fabric spacer layer;

applying conductive material to a first side of said spacer layer, by an embroidery process employing conductive thread or yarn, to define said electrically conductive radiating and/or receiving elements having conductive feedlines attached thereto;

providing, a planar ground reference conductor on the opposite side of said planar spacer layer in a position corresponding to the pattern of said electrically conductive radiating and/or receiving elements having conductive feedlines attached thereto; and providing, a connection whereby said conductive feedlines attached to said electrically conductive radiating and/or receiving elements, and said planar ground reference conductor, can each be connected to associated signal transmitting and/or receiving equipmnent.

2. The method of claim 1, wherein said embroidery step is carried out using a fabric face layer as the substrate for embroidery, and wherein said method further comprises the step of bonding said fabric substrate after performance of said embroidery step to said spacer layer.

3. The method of claim 1, wherein said step of applying conductive material to said spacer layer in a desired pattern, to define said electronically conductive radiating and/or receiving elements having conductive feedlines attached thereto, is performed by disposing a sheet of conductive fabric over a sheet of transfer paper, temporarily bonding the transfer paper to the conductive fabric, cutting the desired pattern of conductive material defining said planar electrically conductive radiating and/or receiving elements having conductive feedlines attached thereto out of said conductive fabric, without substantially damaging said conductive fabric, placing the assembly of conductive fabric and transfer paper to a substrate, attaching the conductive fabric to the substrate and removing the transfer paper.

4. The method of claim 3, wherein said step of attaching the conductive fabric to the substrate is performed using a thermosetting adhesive.

5. The method of claim 4 wherein said thermosetting adhesive is provided as a coating on said conductive fabric.

6. The method of claim 4 wherein said thermosetting adhesive is provided as a separate sheet of adhesive.

7. The method of claim 3, wherein said step of attaching the conductive fabric to the substrate is performed by stitching.

8. The method of claim 3, wherein said substrate to which the conductive fabric is attached is the dielectric spacer layer.

9. The method of claim 3. wherein said substrate to which the conductive fabric is attached is a fabric face layer, which is attached in turn to the spacer layer.

10. The method of claim 1, comprising the further steps of impregnating said spacer layer, having had the conductive material applied to a first side thereof in a desired pattern, so as to define said electrically conductive radiating and/or receiving elements having conductive feedlines attached thereto, and having had said planar ground reference conductor applied to an opposite surface thereof, with a curable resin, thus forming an impregnated assembly, causing said impregnated assembly to take a desired final form and causing said resin to cure forming a substantially rigid structure.

11. The method of claim 10 wherein said step of causing said impregnated assembly to take a desired final form is performed by compressing the impregnated assembly between mating mold halves.

12. The method of claim 11 wherein said step of causing said impregnated assembly to take a desired final form is performed by compressing the impregnated assembly between a mold and an underlying structural member to which the structure is desired to be bonded.

13. The method of claim 1, wherein said step of providing a connection whereby said conductive feedlines attached to said electrically conductive radiating and/or receiving elements, and said planar ground reference conductor, can each he connected to associated signal transmitting and/or receiving equipment is performed employing, an industry-standard connector for connection to a coaxial cable, by securing the contact of said connector adapted to be connected to the center conductor of the coaxial cable in conductive contact with said feedlines, and securing the contact of said connector adapted to be connected to the shield of said coaxial cable in conductive contact with said ground plane.

14. The method of claim 13, wherein the contact of said. connector adapted to be connected to the center conductor of the coaxial cable is a wire, said wire being secured to said feedlines by one of bonding using conductive epoxy, soldering, or stitching said wire directly to a desired point on one of said feedlines.

15. The method of claim 13, wherein the contact of said connector adapted to be connected to the center conductor of the coaxial cable is a wire said wire being secured to said feedlines by being soldered to a patch of conductive wire screen, said patch of conductive wire screen then being stitched to said feedlines to make a. secure connection therebetween.

16. The method of claim 13 wherein the contact of said connector adapted to be connected to the shield of said coaxial cable is a generally cylindrical member for being threaded onto a mating connector on a coaxial cable, said member being secured in conductive contact with stud ground plane by bonding using solder or conductive epoxy.

17. The method of claim 1, wherein said step of applying conductive material to said spacer layer in a desired pattern, to define said electrically conductive radiating and/or receiving elements having conductive feedlines attached thereto is performed by knitting the desired pattern into an outer layer of a warp-knit fabric employing conductive knitting yarns.

18. The method. of claim 17, wherein a conductive ground plane is similarly knit into the opposed layer of said fabric, whereby the interior portion of said fabric defines the spacer layer.

* * * * *